US005099383A

United States Patent [19]

Fukano et al.

[11] Patent Number: 5,099,383

[45] Date of Patent: Mar. 24, 1992

[54] PRINT HEAD ACTIVATING CIRCUIT FOR A WIRE DOT PRINTER

[75] Inventors: Takakazu Fukano; Katsuhiko Nishizawa, both of Suwa, Japan

[73] Assignee: Seiko Epson Corporation, Tokyo, Japan

[21] Appl. No.: 470,485

[22] Filed: Jan. 26, 1990

[30] Foreign Application Priority Data

| | | | |
|---|---|---|---|
| Jan. 27, 1989 | [JP] | Japan | 1-18708 |
| Feb. 9, 1989 | [JP] | Japan | 1-30449 |
| Apr. 27, 1989 | [JP] | Japan | 1-108570 |
| May 18, 1989 | [JP] | Japan | 1-124701 |
| May 23, 1989 | [JP] | Japan | 1-129436 |

[51] Int. Cl.[5] ..... B41J 9/24; H01H 47/32

[52] U.S. Cl. ..... 361/153; 323/272; 101/93.29; 400/157.2

[58] Field of Search ..... 361/153, 156, 152; 323/272; 101/93.02, 93.29; 400/167, 157.2

[56] References Cited

U.S. PATENT DOCUMENTS

| | | | |
|---|---|---|---|
| 4,329,921 | 5/1982 | Treiber et al. | 400/167 |
| 4,429,342 | 1/1984 | Heider | 101/93.29 |
| 4,637,742 | 1/1987 | Sakai | 400/121 |
| 4,667,117 | 5/1987 | Nebgen et al. | 400/157.3 |
| 4,797,017 | 1/1987 | Okouchi | 101/93.03 |
| 4,940,343 | 7/1990 | Kikuchi et al. | 361/153 |

FOREIGN PATENT DOCUMENTS

| | | | |
|---|---|---|---|
| 0242635 | 10/1987 | European Pat. Off. . | |
| 0294288 | 7/1988 | European Pat. Off. . | |
| 161549 | 7/1987 | Japan . | |
| 0172661 | 7/1988 | Japan | 101/93.29 |
| 63-53681 | 10/1988 | Japan . | |
| 63-254076 | 10/1988 | Japan . | |

*Primary Examiner*—A. D. Pellinen
*Assistant Examiner*—Richard T. Elms
*Attorney, Agent, or Firm*—Blum Kaplan

[57] ABSTRACT

A print head activation circuit for a wire dot printer includes a first switch and a second switch. A CPU produces a printing timing control signal. A first driving signal-generating circuit produces a first driving signal pulse having a pulse width $T_1$ in response to the printing timing control signal. A delay circuit delays the first driving signal. A second driving signal-generating means produces a second driving signal pulse having a pulse width $T_2$ in response to the leading edge of the delayed first driving signal. The first switching means is connected with a DC power supply. The first switching means is also connected with one terminal of each actuator coil of the print head. The second switching means is connected between a second terminal of the actuator coil and ground. The second driving signal-generating means is operated in response to the delayed first driving signal. The delay time $\Delta T$ is set so that the first switching means is biased into conduction simultaneously with or earlier than the second switching means.

36 Claims, 10 Drawing Sheets

FIG. 13a
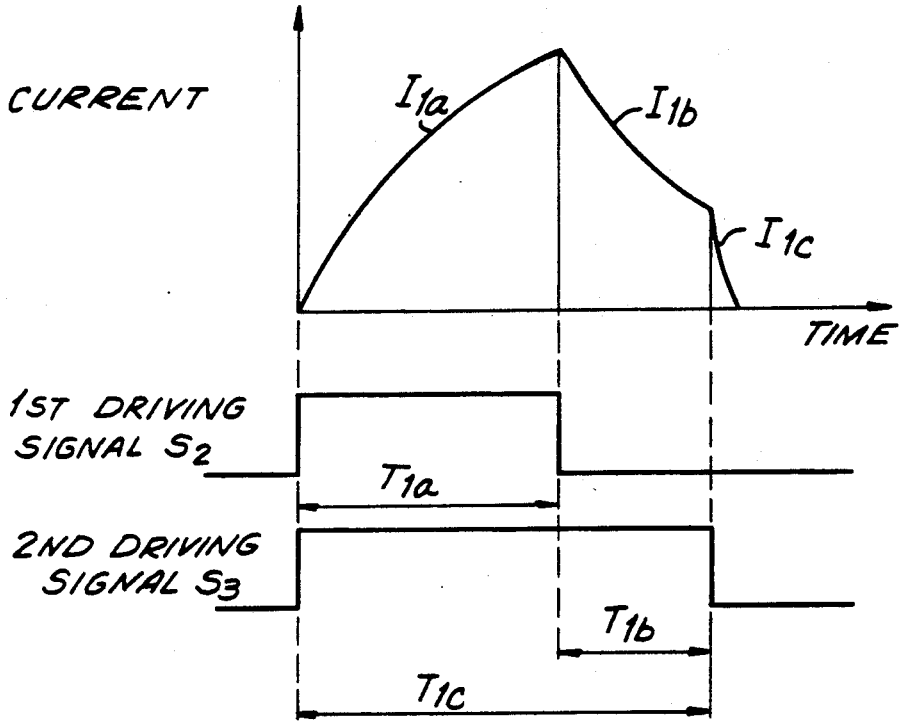
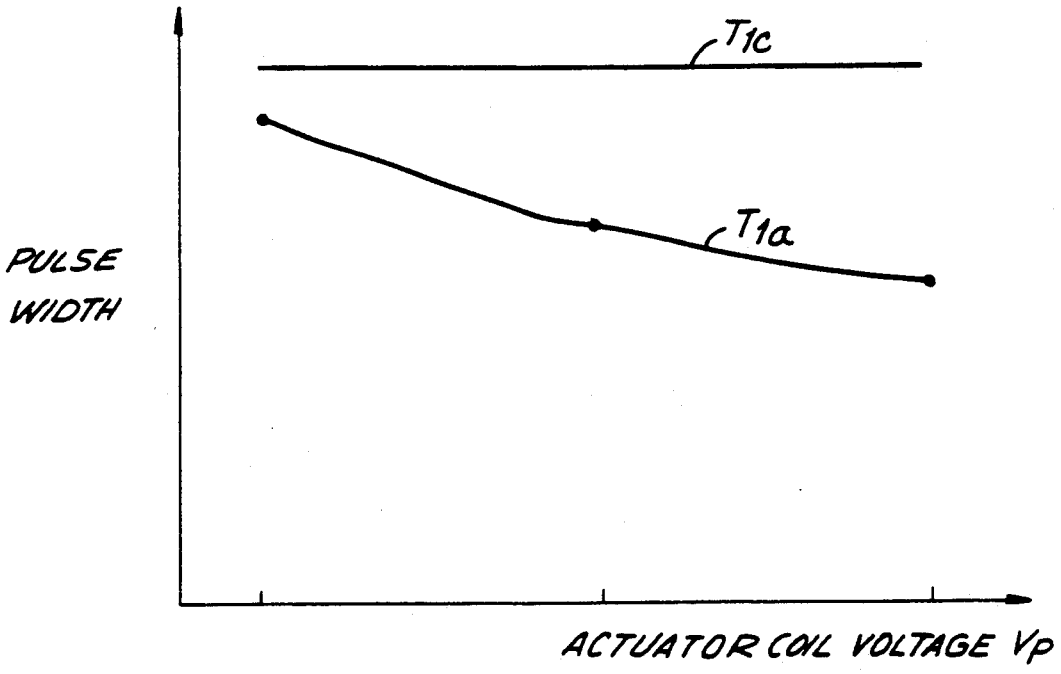
FIG. 13b

PRINT HEAD ACTIVATING CIRCUIT FOR A WIRE DOT PRINTER

BACKGROUND OF THE INVENTION

This invention relates to a wire dot printer which prints by activating an actuator coil to select specific wire ends from a matrix of wire ends and, more particularly, to a circuit for activating the actuator coil within the print head to cause the wire ends to move.

Conventional wire dot print heads are known in the art and generally include a case which also acts as a magnetic core. A plurality of actuator coils are circumferentially disposed about the case. Print levers upon which the print wires are mounted are positioned within the case so that they are attracted by the coils when the coils are energized. The wires mounted upon the levers are caused to impact against paper held about a platen when the print levers are attracted by the coils.

Such conventional wire dot print heads have been satisfactory. However, such print heads are activated by a drive circuit which outputs voltage pulses in accordance with the characters to be printed. Because each coil included in the circuit has reactance, electric power builds up within the coils. Therefore, as shown in FIG. 14, if a neighboring switching device is turned ON to activate a particular coil, an electric current $I_0$ will again flow to the actuator coil due to the electromotive force induced by a change in the residual magnetic flux stored in a magnetic circuit in the print head even though a printing operation has been completed and the print wires are returning to a home position during the activation of the second print wire. Therefore, the previously activated print wire is returned to its home position with accumulated delays. If the build up is too great or the accumulation too great, the result is protruding wires making printing impossible to perform.

Driver circuits are known for activating a wire dot print head which attempt to prevent electric current from flowing through the actuator coils when a change in residual magnetic flux stored in the magnetic circuit induces electromotive force during the return action of the lever. One such circuit is known from Japanese Utility Model Laid Open Application No. 191,032/88 which includes a driver circuit for activating the print head of a wire dot printer in which each actuator coil is connected to first switching terminal at one coil terminal and a second independent switching device at the other coil terminal. The first switching device receives a first driving signal in synchronism with printing. The second switching device receives a second driving signal which is produced in accordance with data related to the character to be printed. The terminal of each actuator coil connected to the first switching device is grounded by a diode while the other terminal is connected with a driving DC power supply through a counter electromotive force-absorbing circuit.

In the circuit configuration described above, a first driving signal having a pulse width $T_1$ is input to the first switching device in synchronism with a timing control signal. A second driving signal having a pulse width $T_2$ which is longer than the first driving signal pulse width is input to the second switching device for a selected actuator coil. The driving DC power supply energizes the actuator coil by supplying electric current which serially flows through the first switching device, the actuator coil, and the second switching device. This causes the coil to attract a selected lever moving the wire towards the platen.

After a period $T_1$, the first switching device is turned OFF to deenergize the coil. The resulting counter electromotive force maintains an electric current flowing through the second switching device, the ground, a diode, and the actuator coil, thus maintaining the coil in an energized state. After a period $T_2$, the second switching device is turned OFF. The resulting counter electromotive force induces electric current to serially flow through ground, the diode, the actuator coil, a second diode, and the counter electromotive force-absorbing circuit. In this way, electric current is fed to the driving power supply. As a result, the counter electromotive force induced in the actuator coil drops below the sum of the voltage developed by the DC power supply and the zener voltage of the voltage-regulator diode. For this reason, if another actuator coil is energized, no deleterious electric current is produced. Hence, the wire can be quickly returned to its home position by a spring.

In this driver circuit, the deleterious current produced during the return of the print lever can be reduced to a quite small value. However, magnetic flux still remains in the headactuating circuit including the actuator coils. If the second switching device is turned ON before the first switching device, an electrical path consisting of the diode, the actuator coil, and the second switching device is formed. The result, as can be seen in FIG. 15, is that electric current $I_0'$ is generated in the coil before the wire is to be actuated. Where the print speed is low and wires are driven at longer intervals of time, this current $I_0'$ due to the electromotive force attrituted to the residual magnetic flux poses no serious problems, because it is quite small. However, presently printers have been required to print at higher speeds. To comply with this requirement, wires are designed to stop within shorter time intervals and a higher voltage is applied to each actuator coil to supply a larger electric current in a shorter time. Because the actuator coils stop in a shorter time, the next character must be printed before the residual magnetic flux created by the previous energization has had an opportunity to dissipate. It also follows that the time between the instant at which one wire returns to its home position and the instant at which the next wire is started to be activated is reduced.

To obtain the required large electric current, the first switching device is connected with the DC power supply which delivers a relatively high voltage, usually on the order of 35 V. The first switching device is a PNP transistor. The base of a PNP transistor cannot be directly driven by a TTL circuit that has a maximum tolerance of more than 5 V. Therefore, it is the common practice to connect an NPN transistor before the first switching device to convert the driving signal into a higher voltage. On the other hand, the emitter of the second switching device is connected to the ground of the DC power supply and so the second device can be turned on by applying a signal exceeding a certain level, normally 0.6 V, to the base. Consequently, the second device can be driven directly with the driving signal from the TTL circuit.

If the driving signal is applied to the first and second switching devices simultaneously, the first device is turned ON after a delay equal to the time taken to turn ON the NPN transistor inserted in the front stage to increase the driving signal level. Even though, the driving signal for both switching devices is simultaneously supplied in response to a timing signal, there exists a period in which only the second device is in a conducting state. This conduction is combined with the electromotive force induced in the actuator coil due to the residual magnetic flux produced by the previous printing operation to thereby give rise to circulating electric current. The actuator coil for the next lever driven is energized earlier than intended. Thus, a character is printed at an incorrect time. As a result, the distance traveled by each successively driven wire decreases, as shown by the dotted line in FIG. 15. In a worst case, a printing wire is caught by the ink ribbon and becomes damaged or some dots fail to be printed, which leads to a deterioration of the print quality.

Accordingly, there is a need for a print head activating circuit for a wire dot printer which overcomes the deficiencies of the prior art by reducing the residual deleterious current remaining within an actuator coil from a previous printing operation.

SUMMARY OF THE INVENTION

Generally speaking, in accordance with the invention, a print head activation circuit energizes a selected actuator coil to effect printing by attracting a print lever to the actuator coil when energized. A first switch has an input terminal coupled to a driving DC power supply through a level conversion circuit and receives an input signal therefrom. The output signal of the first switch is connected with a first terminal of each actuator coil. A second switch is connected between the second terminal of each actuator coil and ground. A diode is connected between the first terminal of each actuator coil and ground in a reverse direction as viewed from the DC power supply to absorb the counter electromotive force remaining in the actuator coils. A counter electromotive force absorbing circuit is connected between the second terminal of each actuator coil and the DC power supply. A first driving signal generating circuit produces a first driving signal in response to a printing timing control signal as a pulse having a pulse width $T_1$ for turning the first switch ON. A delay circuit produces a delayed first driving signal. A second driving signal generating circuit produces a second driving signal upon the leading edge of the delayed first driving signal for turning ON the second switch. The second driving signal being a pulse having a width of $T_2$ and the delay circuit delaying the first driving signal by a time period $\Delta T$. The delay time $\Delta T$ of the delay circuit is set so that the first switch is turned ON simultaneously with or earlier than the second switch.

Accordingly, it is an object of the invention to provide an improved print head activation circuit for a wire dot printer.

Another object of the invention is to provide an improved print head activation circuit which allows a lever to quickly return to its home position after printing thus enabling high speed printing.

A further object of the invention is to provide a print head activation circuit which prevents generation of electric current which is otherwise being produced by electromotive force induced by the magnetic flux remaining from the previous activation allowing each wire to return to its home position.

A further object of the invention is to provide an improved print head activation circuit in which the counter electromotive force produced immediately after the activation of a coil is absorbed by counter electromotive force absorbing circuit allowing the return of the print lever and wires to a home position as quickly as possible.

Still another object of the present invention to provide a print head activation circuit which activates the print head of the wire dote printer while preventing generation of an electric current when the electromotive force is produced during a return of the print wire to its home position resulting from residual magnetic flux during high speed operation.

Yet another object of the present invention is to provide an improved print head activation circuit which allows for the operation of print wires at the correct timings specified by a driving signal to allow printing of characters at high speed with high print quality.

Still other objects and advantages of the invention will in part be obvious and will in part be apparent from the specification.

The invention accordingly, comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 13*a–b* are graphs showing the relationship between the actuator coil voltage and the pulse width;

DESCRIPTION OF THE PREFERRED EMBODIMENTS

Figure 1:
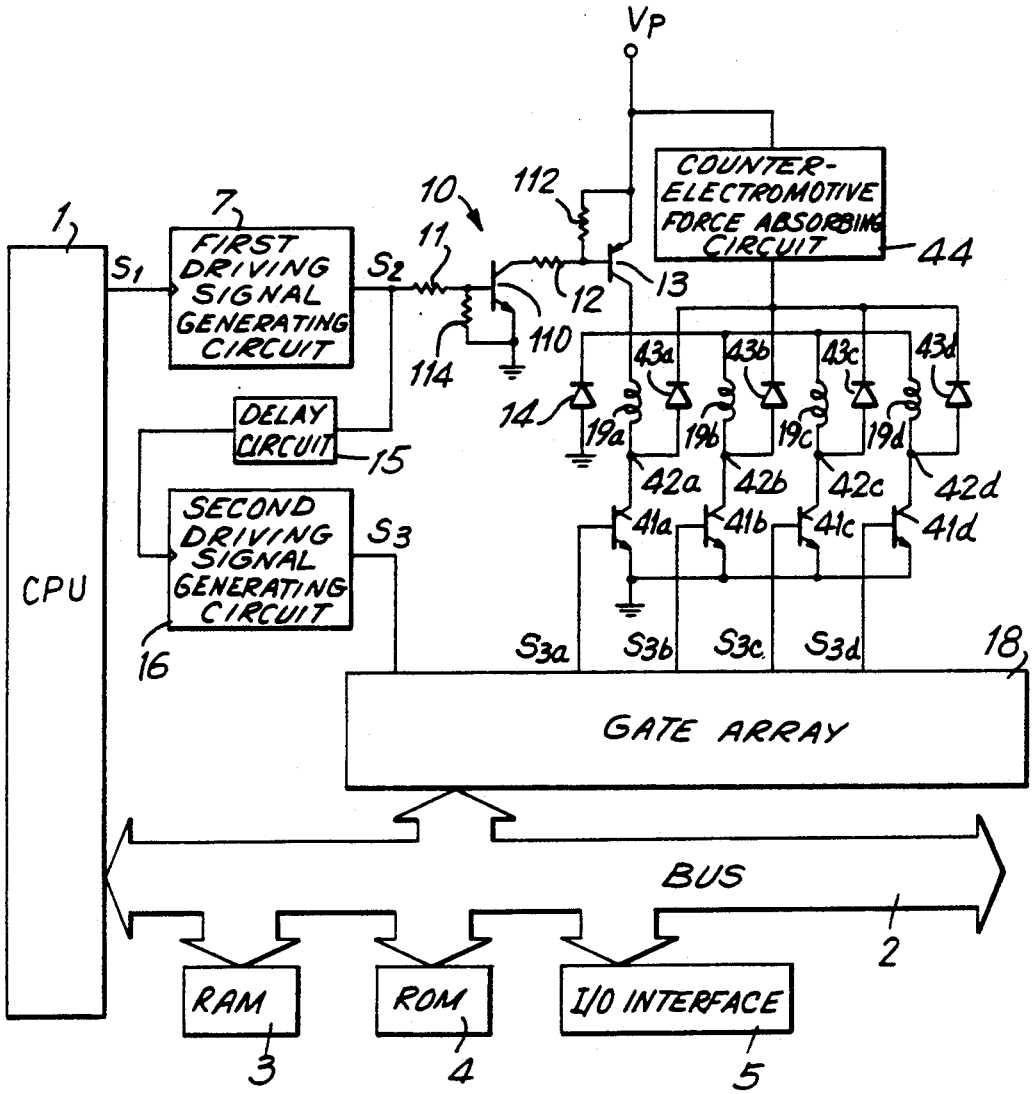
FIG. 1 is a block diagram of a print head activation circuit for a wire dot printer constructed in accordance with the invention.

Reference is first made to FIG. 1 wherein a block diagram of a print head activation circuit of the invention is provided. This circuit activates the print head of a wire dot printer (not shown). The circuit includes a central processing unit ("CPU") 1 which is connected with a RAM 3, or ROM 4, and an I/O interface 5 through bus 2 to form a microcomputer for controlling the printing operation. CPU 1 receives data about characters to be printed from an external device (not shown) through I/O interface 5. In response to the incoming data, CPU 1 produces a timing control signal $S_1$ at its output terminal for activating the print head. CPU 1 is also programmed to output a signal for selecting each actuator coil to be activated through a gate array 18.

A first driving signal-generating circuit 7 includes a TTL circuit. First driving signal generating circuit 7 receives control signal $S_1$ and outputs a first driving signal $S_2$ having a pulse duration of $T_{1a}$ (FIG. 5) in synchronism with the timing control signal $S_1$.

A level converter circuit 10 includes an NPN transistor 110 having its base connected with an output terminal of first driving signal-generating circuit 7 through a resistor 11. The collector of NPN transistor 110 is connected with the base of a first switching transistor 13 through a resistor 12, while the emitter of NPN transistor 110 is grounded. A resistor 114 is coupled between ground and the base of NPN transistor 110.

First switching transistor 13 is a PNP transistor which can sufficiently withstand the output voltage from a driving DC power supply (not shown). The emitter of the first switching transistor 13 is connected with the output terminal Vp of the DC power supply. The collector is connected with each first terminal of a plurality of actuator coils 19*a*, 19*b*, 19*c*, 19*d* which form the print head and also with ground through a diode 14 whose anode is grounded. A resistor 112 is connected between the emitter and base of switching transistor 13.

A plurality of second switching transistors 41*a*, 41*b*, 41*c* 41*d* each have their bases connected with output terminals $S_{3a}$, $S_{3b}$, $S_{3c}$, $S_{3d}$, respectively, of gate array 18. Each second switching transistor 41*a*, 41*b*, 41*c*, 41*d* being an NPN transistor. The respective collectors of the second switching transistors 41*a*, 41*b*, 41*c*, 41*d* are connected with a respective second terminal of actuator coils 19*a*, 19*b*, 19*c*, 19*d*, and the emitters are grounded. The junction points 42*a*, 42*b*, 42*c*, 42*d* of the second switching transistors 41*a*, 41*b*, 41*c*, 41*d* and actuator coils 19*a*, 19*b*, 19*c*, 19*d*, respectively, are connected to the input terminal of a counter electromotive force-absorbing circuit 44 through diodes 43*a*, 43*b*, 43*c*, 43*d*, respectively, which are connected in the reverse direction as viewed from the power terminal Vp. Diode 14 acts with counter electromotive force absorbing circuit 44 to absorb the counter electromotive force.

In this embodiment, a delay, circuit 15 is coupled to the output terminal of first driving signal-generating circuit 7. The delay time $\Delta T$ of this delay circuit is set so that second switching transistors 41*a*, 41*b*, 41*c*, 41*d* are turned ON simultaneously with or later than first switching transistor 13.

Figure 2A:
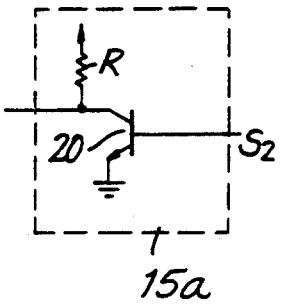
FIGS. 2*a*–2*c* are circuit diagrams of three embodiments of the delay circuit constructed in accordance with the invention which can be used in the circuit shown in FIG. 1.
Figure 2B:
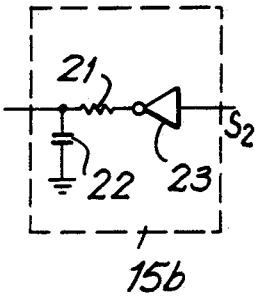
Figure 2C:
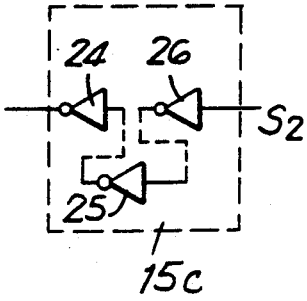

Reference is made to FIGS. 2*a*, 2*b*, and 2*c* in which different embodiments of delay circuit 15 generally indicated as delay circuits 15*a*–15*c* are provided. In delay circuit 15*a* a transistor 20 is employed in which first driving signal $S_2$ is input at its base, its emitter is grounded and its collector is coupled to a voltage source through a resistor R for outputting the delayed signal. Positive use of the time taken to turn transistor 20 ON is made. Delay circuit 15*b* includes an inverter 23 connected in series with an integrator circuit that consists of a resistor 21 in series with the output of the circuit and a capacitor 22 coupled between the output and ground. The time required for the integrated voltage to reach the operating voltage of inverter 23 is utilized to provide the delay. Delay circuit 15*c* includes inverters 24, 25, 26 connected in series to make use of the delay time of the inverter circuit. In this example, three inverters are used by way of example only. The number of inverters may be selected according to the required delay time.

Referring again to FIG. 1, a second driving signal generating circuit 16 receives the output signal from the delay circuit 15 and produces a second driving signal $S_3$ having a pulse width $T_{1c}$ longer than the pulse width of the first driving signal $S_2$. Gate array 18 receives second driving signal $S_3$. Gate array 18 is equipped with a plurality of output terminals $S_{3a}$, $S_{3b}$, $S_{3c}$, $S_{3d}$ corresponding to each actuator coil and delivers printing signals in synchronism with the second driving signal $S_3$ in accordance with data about characters to be printed. Only four output terminals and actuator coils are used by way of example, the actual number may be more or less to correspond to the number of print levers.

Figure 3:
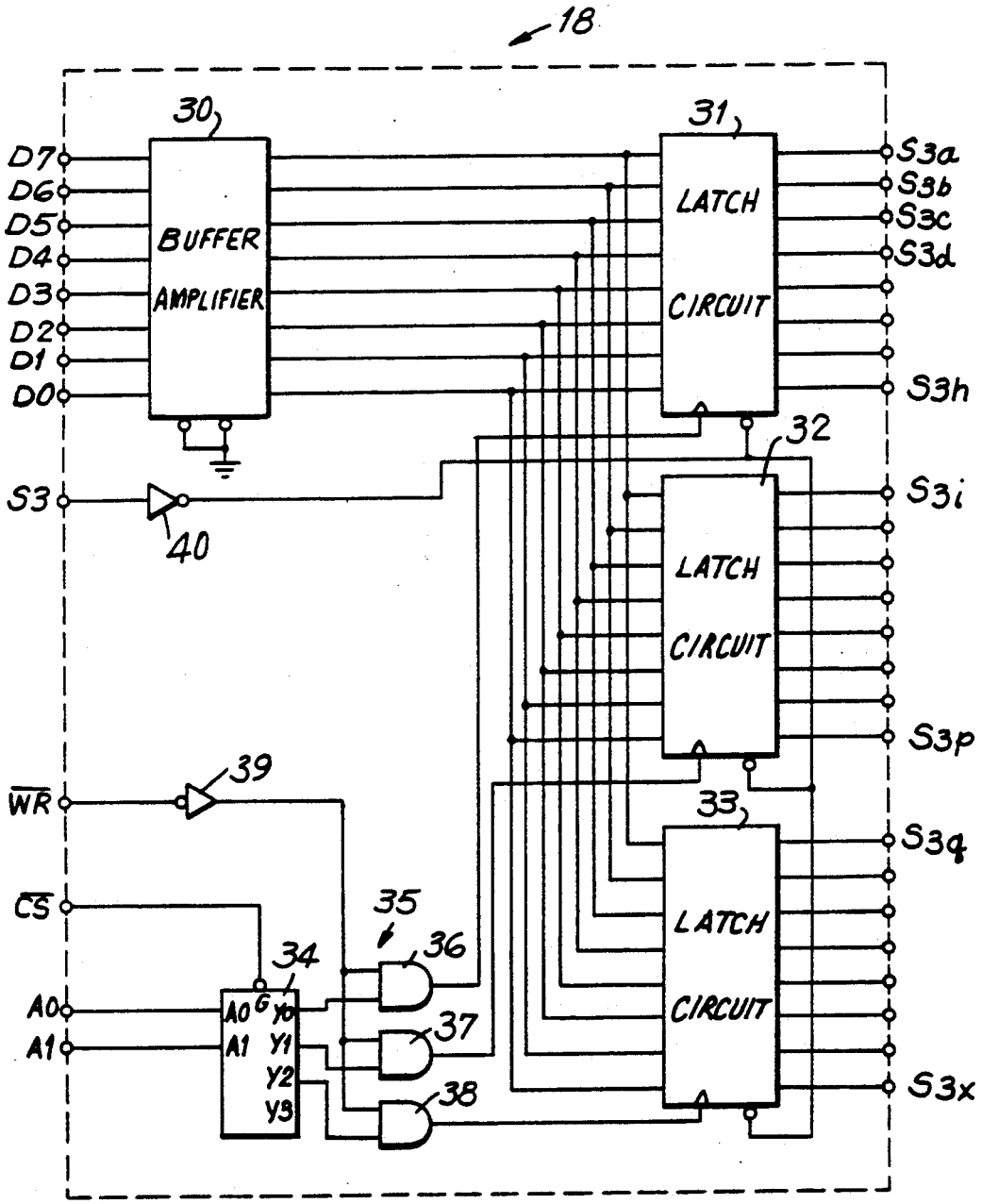
FIG. 3 is a block diagram of gate array constructed in accordance with the invention for use in the circuit shown in FIG. 1.
Figure 4A:
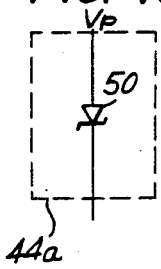
FIGS. 4*a*–4*d* are circuit diagrams of four embodiments of the counter electromotive force-absorbing circuit constructed in accordance with the invention for use in the circuit shown in FIG. 1.
Figure 4B:
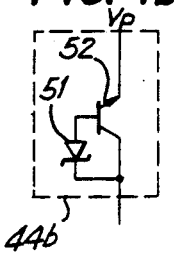
Figure 4C:
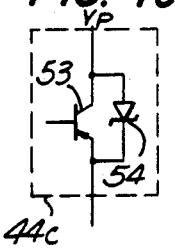
Figure 4D:
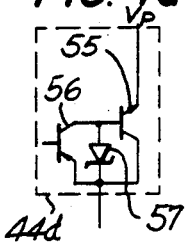

Reference is now made to FIG. 3 in which one embodiment of gate array 18 is provided. This embodiment includes three latch circuits 31, 32, 33 each providing respective outputs from gate array 18. A decoder 34 is coupled to latch circuits 31, 32, 33 through a gate circuit 35, including AND gates 36, 37, 38 and inverter 39, for selecting one of latch circuits 31–33. The latch circuits 31–33 are connected with a bus 2 (FIG. 1) through a buffer amplifier 30 and receives data inputs D0–D7. Decoder 34 is connected with bus 2 and receives inputs A0, A1, $\overline{CS}$. Dot signals for performing printing operations are latched in latch circuits 31, 32, 33 according to an address signal input from bus 2. When second driving signal $S_3$ produced by second driving signal-generating circuit 16 arrives at the gate array it is inverted by an inverter 40 and input to latch circuits 31, 32, 33 so that signals synchronized with second driving signal $S_3$ appear at terminals $S_{3a}$, $S_{3b}$, $S_{3c}$, $S_{3d}$ connected with respective actuator coils 19*a*, 19*b*, 19*c*, 19*d*, to which the printed dots are assigned.

Reference is now made to FIG. 4 in which different embodiments of counter electromotive force-absorbing circuits 44 generally indicated as 44*a*, 44*b*, 44*c*, and 44*d* are provided. Counter electromotive force-absorbing circuit 44*a* includes a voltage-regulator diode 50 having its anode coupled to input terminal Vp. Counter electromotive force-absorbing circuit 44b includes a voltage regulator diode 51 having a relatively small current capacity connected between &:he collector and the base of a switching transistor 52. The emitter of switching transistor 52 is connected to terminal Vp. Counter electromotive force-absorbing circuit 44c includes a switching transistor 53 with its emitter-collector paths connected in parallel with a voltage-regulator diode 54. The zener voltage of diode 54 and the conducting voltage of the transistor 53 are utilized to absorb the energy. Counter electromotive force-absorbing circuit 44d includes a transistor 56 connected with its emitter-collector path in parallel with a voltage-regulator diode 57. The parallel connection of voltage regulator diode 57 and transistor 56 are connected between the base and the collector of a transistor 55 which controls conduction. The conducting voltage of the transistor 55 is controlled by the zener voltage of diode 57 and the conducting voltage of the transistor 56.

Figure 5:
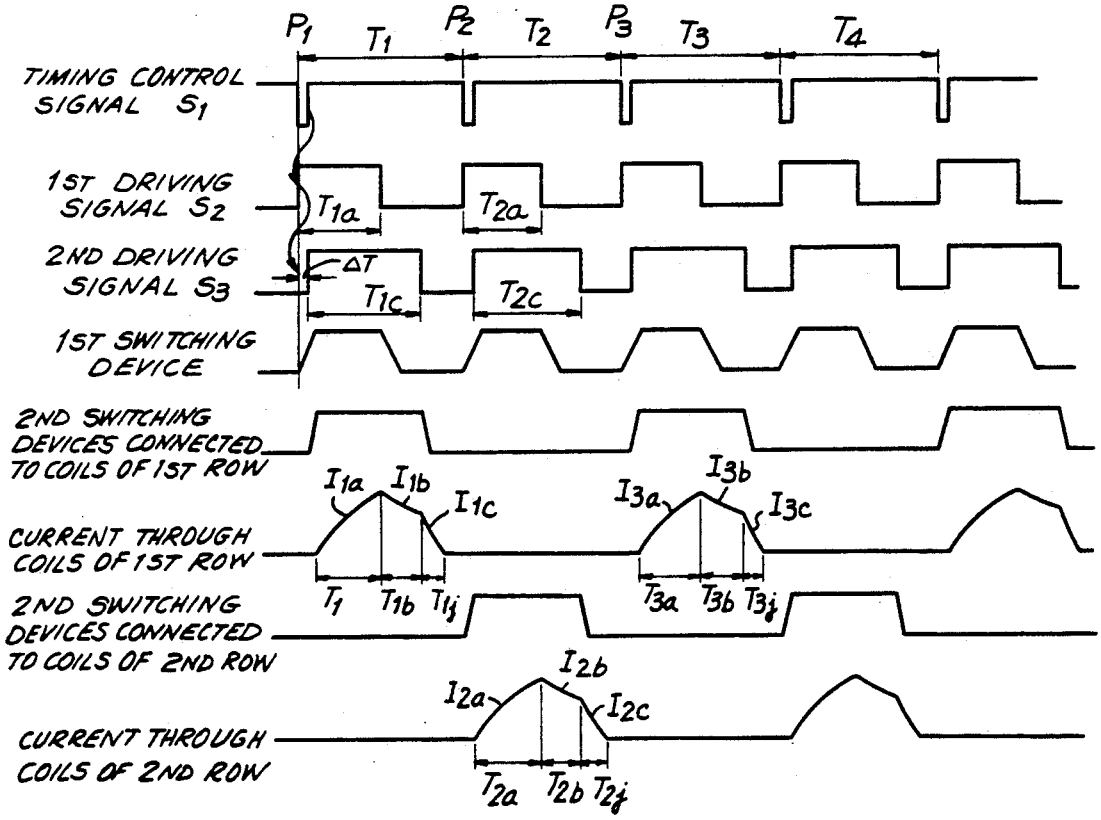
FIG. 5 is a waveform timing diagram illustrating the operation of the activation circuit shown in FIG. 1.

Reference is now also made to FIG. 5 in which a timing chart for operation of the print head activation circuit is provided. In the following description, it is assumed that actuator coils 19a and 19c print odd-numbered rows, while actuator coils 19b and 19d print even-numbered rows and that coils 19a–19d are merely representative of a larger number of actuator coils.

CPU 1 outputs a timing control signal $S_1$ having a predetermined period; timing control signal $S_1$ essentially determining the movement of the carriage (not shown) and the timing of printing. First driving signal-generating circuit 7 outputs first driving signal $S_2$ having a pulse width $T_{1a}$ simultaneously with the leading edge of timing control signal $S_1$. First driving signal $S_2$ is applied to level conversion transistor 10 to turn ON first switching transistor 13 when the sum of the time required to turn ON transistor 10 and the time required to turn ON the switching transistor 13 has elapsed.

First driving signal $S_2$ output by first driving signal-generating circuit 7 is also applied to the delay circuit 15 having the delay time $\Delta$ T and then fed to the second driving signal-generating generating circuit 16 with the delay $\Delta$ T, thus initiating the operation of gate array 18.

CPU 1 outputs the data about characters to be printed to gate array 18 which turns second switching transistor 41a or 41c ON which in turn is connected with a corresponding actuator coil 19a or 19c of the print head. First and second driving signal-generating circuits 7, 16 and gate array 18 are each composed of a TTL circuit and therefore respond at much higher speeds than first and second switching transistors 13a and 41a or 41c and level conversion transistor 110. Therefore, the delays introduced by them can be neglected.

The first driving signal applied to second switching transistor 41a is delayed $\Delta$ T by delay circuit 15 as described above. Therefore, first switching transistor 13 is driven into conduction simultaneously with or earlier than second switching transistor 41a. When transistor 41a is biased into conduction, actuator coil 19a or 19c is supplied with DC power from the driving DC power supply. Actuator coil 19a or 19c is energized with electric current $I_{1a}$ which increases with a time constant determined by a reactance and internal resistance of the coil. When the time determined by the pulse width $T_{1a}$ of first driving signal-generating circuit 7 elapses, first switching transistor 13 is turned OFF, so that coil 19a or 19c is deenergized.

Figure 6:
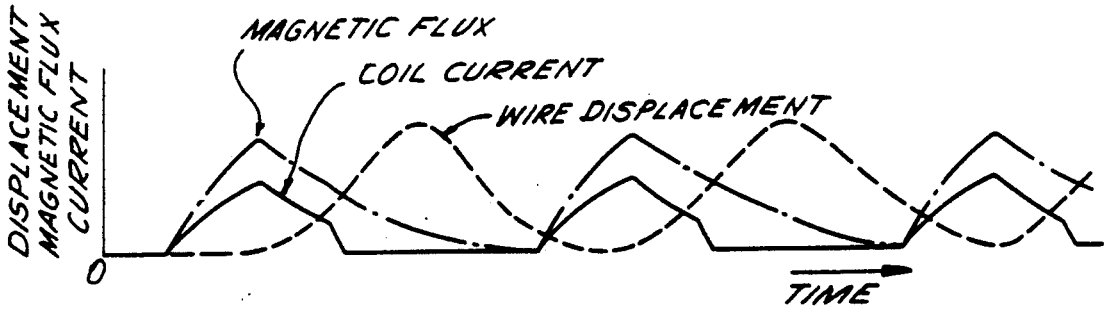
FIG. 6 is a graph showing the relation among the electric current flowing through each actuator coil energized by the circuit shown in FIG. 1, the displacement made by the corresponding wire, and the produced magnetic flux.

Second driving signal-generating circuit 16 continues to produce second driving signal $S_3$ keeping second switching transistor 41a in a conduction state. The counter electromotive force induced in actuator coil 19a when the first switching transistor 41a is biased OFF produces circulating electric current $I_{1b}$ which flows through second switching transistor 41a, ground, diode 14, and actuator coil 19a in order. This causes coil 19a to keep producing magnetic flux to attract the lever. In this manner, when time $t_{1b}$ elapses since the second driving signal $S_3$ ceases i.e., when time $T_{1c}$ has elapsed since the operation was started, the driving signal $S_3$ from the second driving signal-generating circuit 16 ceases. As a result, second switching transistor 41a is driven to a cutoff state. The counter electromotive force induced in coil 19a produces electric current $I_{1c}$ which flows through diode 43a, the counter electromotive force-absorbing circuit 44, and the power terminal Vp into the DC power supply. Thus, when the voltage of the counter electromotive force drops below the sum of the voltage at the power terminal Vp, the conducting voltage of counter electromotive force-absorbing circuit 44, and the forward voltage of diode 43a, the current ceases, while the residual magnetic flux decreases gradually as shown in FIG. 6. This assures that the electromotive force arising from the magnetic flux remaining at the middle point of the period is prevented from producing electric current $I_0$ (FIG. 14).

When the first printing step ends, CPU 1 produces the next timing control signal $S_2$ to permit actuator coils 42b and 42d which were not activated in the first printing step to be energized. Specifically, when the second timing control signal $S_2$ is produced, first driving signal-generating circuit 7 outputs a common signal $S_2$ having a pulse width of $T_{2a}$. First switching transistor 13 receives common signal $S_2$ and is turned ON after a lapse of time determined by the sum of the times respectively required for transistor 10 and first switching transistor 13 to begin conducting. Then, first switching transistor 13 applies a voltage to all actuator coils 19a, 19b, 19c and 19d. Simultaneously, first driving signal $S_2$ output by first driving signal-generating circuit 7 is input to delay circuit 15 and then input to second driving signal-generating circuit 16 with a delay $\Delta$ T. Second driving signal-generating circuit 16 produces a second driving signal $S_3$ having a pulse width $T_{2c}$. Because second driving signal $S_3$ is delayed $\Delta$ T by delay circuit 15, first switching transistor 13 is biased into conduction simultaneously with or earlier than second switching transistor 41a regardless of delay times required for transistor 13 and transistor 10 to be biased into cutoff. Accordingly, the DC power supply applies a reverse voltage to the diode 14 to bias it into cutoff.

The previously energized actuator coil 19a still has residual magnetic flux and keeps producing electromotive force. The voltage developed by the DC power supply maintains diode 14 in cutoff state. Therefore, if second switching transistor 41b conducts, the counter electromotive force induced in actuator coil 19a can not energize the coil 19a. For this reasons, coil 19a presently energized is not energized with unwanted electric current. It is only driven at the timing specified by second driving signal $S_3$. Consequently, the print lever and wire move just as intended at the time of the design of the print head. After the printing operation, they return to their home positions with certainty. In this way, when third timing control signal $S_3$ is produced, the levers which were driven by the actuator coils 19a and 19c energized in the previous printing step have returned to their home positions. Hence, they can respond exactly to the next driving signal.

Figure 7:
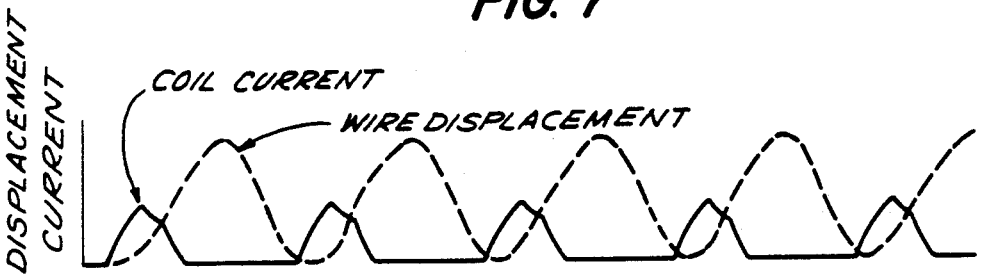
FIG. 7 is a graph showing the relation between the displacement made by a wire and the electric current flowing through a coil when a print head is activated by the circuit shown in FIG. 1.
Figure 14:
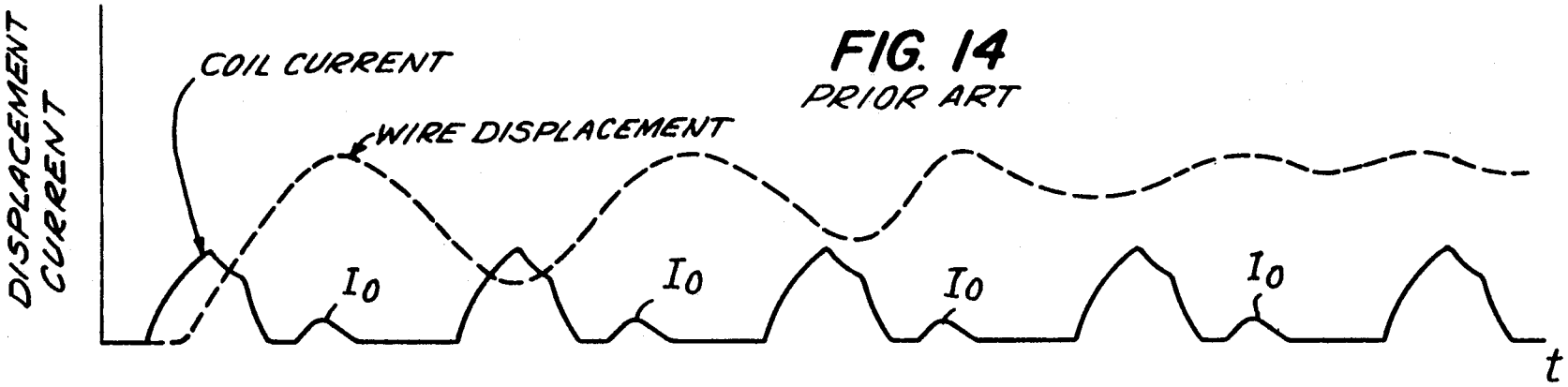
FIG. 14 PRIOR ART
FIG. 14 is a graph showing the relationship between the electric current flowing through a coil and the displacement made by a wire that is activated by a coil energized by a conventional print head-activation circuit.
Figure 15:
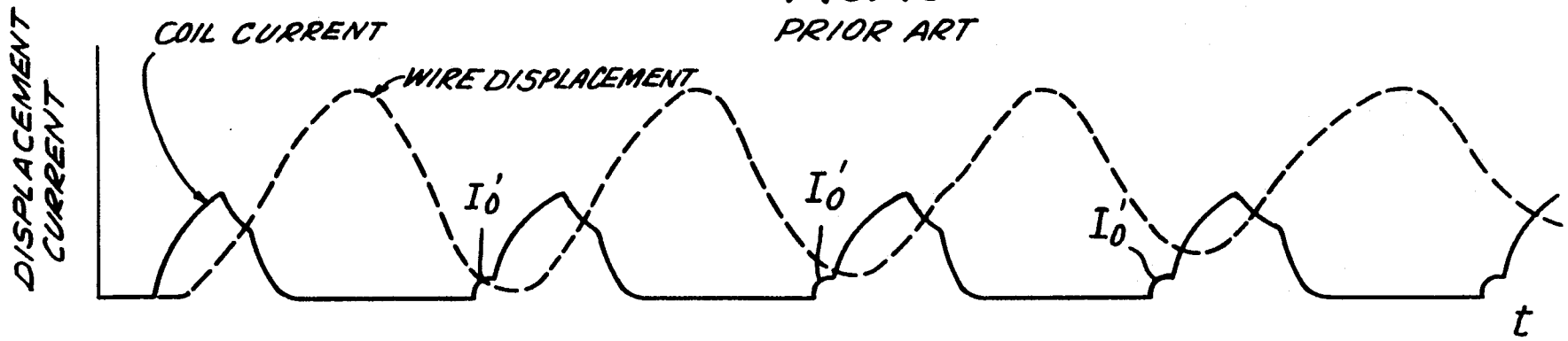
FIG. 15 PRIOR ART
FIG. 15 is a graph showing the relationship between the electric current flowing through a coil and the displacement made by a wire, in which the wire is activated by another conventional print head-activation circuit.

In the prior art, as shown in FIGS. 14 and 15 described above, the lever was attracted by unwanted electromagnetic force. This effect built up as the lever was repeatedly driven and so the amount by which the wire was returned decreased with time. Finally, the wire protruded toward the platen. On the other hand, when the print head was activated by the activating circuit shown in FIG. 1, the residual magnetic flux produced by the previous activation generated no electric current immediately before the intended wire was driven, as well as during the present activation, as shown in FIG. 7. Consequently, each printing wire returned to its home position during each printing operation. In this way, the activating circuit could control the movement of each printing wire as desired and cause the print head of the wire dot printer to print with high print quality.

Figure 8:
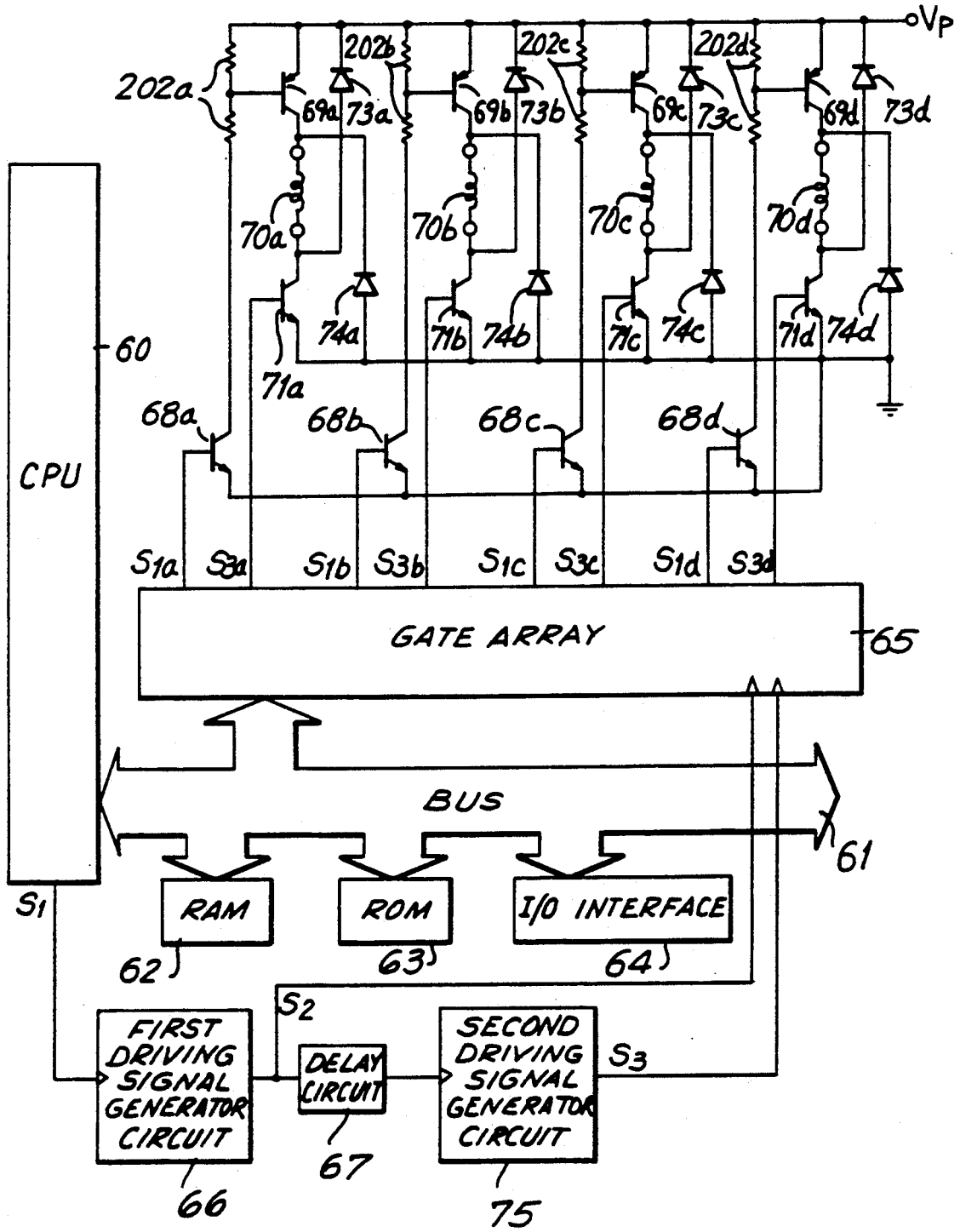
FIG. 8 is a block diagram of another embodiment of a print head activation circuit constructed in accordance with the invention.

Reference is now made to FIG. 8, in which a block diagram of print head activation circuit constructed in accordance with another embodiment of the invention is provided. This embodiment is similar to that of FIG. 1, the primary difference being the removal of the counter electromotive force absorbing circuit.

The circuit of FIG. 8 includes a central processing unit 60 (CPU) which is connected with a RAM 62, a ROM 63, and an I/O interface 64 by a bus 61 to form a microcomputer for controlling printing operation. CPU 60 receives data regarding printed characters from an external device (not shown) through the interface 64. CPU 60 is programmed to produce a timing control signal $S_1$ for driving a print head at its output terminal in response to the incoming data. CPU 60 also produces an output signal to a gate array 65 for select respective actuator coils. Each of a plurality of transistors 68*a*, 68*b*, 68*c*, 68*d* provided for level conversion consists of an NPN transistor. The respective collectors of transistors 68*a*, 68*b*, 68*c* and 68*d* are connected through series resistor pairs 202*a*, 202*b*, 202*c* and 202*d*, respectively, to a terminal Vp of a DC power supply. Their bases are connected with output terminals $S_{1a}$, $S_{1b}$, $S_{1c}$, $S_{1d}$, respectively, of gate array 65 producing first driving signal $S_2$. Transistors 68*a*–68*d* act to turn first switching transistors 69*a*, 69*b*, 69*c*, 69*d*, respectively, ON or OFF. The emitters of the first switching transistors 69*a*, 69*b*, 69*c*, 69*d* are connected with a terminal Vp of a driving DC power supply, while the collectors are connected with respective first terminals of actuator coils, 70*a*, 70*b*, 70*c*, 70*d*. The bases of transistors 69*a*, 69*b*, 69*c*, 69*d* are respectively connected intermediate the respective resistor pairs 202*a*, 202*b*, 202*c* and 202*d* of the respective level conversion transistors 68*a*, 68*b*, 68*d*, respectively, said resistor pairs serving as voltage dividers. A plurality of second switching transistors 71*a*, 71*b*, 71*c*, 71*d* have their collectors connected to the second terminals of coils 70*a*, 70*b*, 70*c*, 70*d*, respectively and their respective emitters are commonly grounded. The bases of transistors 71*a*–71*d* are connected to terminals $S_{3a}$, $S_{3b}$, $S_{3c}$, $S_{3d}$, respectively, of gate array 65 which output the second driving signal $S_3$. The respective second terminals of coils 70*a*–70*d* are connected with the terminal Vp of the power supply through first diodes 73*a*, 73*b*, 73*c*, 73*d*, respectively, the cathodes of said first diodes being coupled to terminal Vp. The respective second terminals of coils 70*a*–70*d* are connected with ground through second diodes 74*a*, 74*b*, 74*c*, 74*d*, respectively, to form a counter electromotive force circuit, the anodes of said second diodes being coupled to ground.

A first driving signal-generating circuit 66 includes a TTL circuit and outputs a first driving signal $S_2$ having a pulse width of $T_{1a}$ in synchronism with timing control signal $S_1$. An output terminal of first driving signal generating signal 66 is connected to a first input terminal of a gate array 65. A delay circuit 67 receives first driving signal $S_2$ from the first driving signal-generating circuit 66. Delayed signal $S_2$ is output to a second driving signal-generating circuit 75 with a delay time $\Delta$ T. This delay circuit 67 can be any one of the delay circuits 15*a*, 15*b* or 15*c*. The delay time is set in such a way that first and second switching transistors 69*a*, 69*b*, 69*c*, 69*d* and 71*a*, 71*b*, 71*c*, 71*d* are biased into conduction at the same time. Second driving signal-generating circuit 75 receives the output signal from delay circuit 67 and produces a second driving signal $S_3$ having a pulse width $T_{1c}$ longer than that of first driving signal $S_2$.

Figure 9:
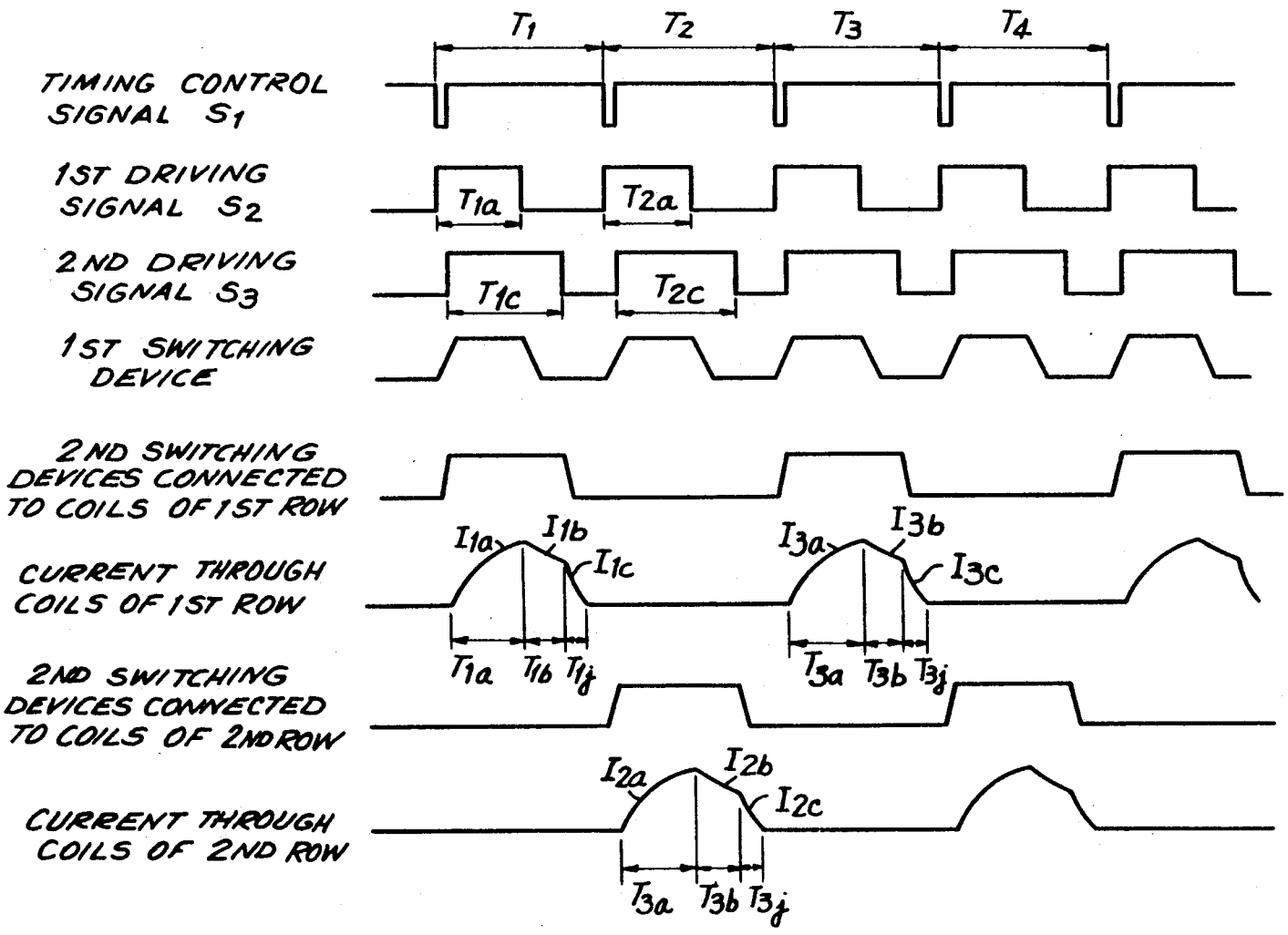
FIG. 9 is a waveform timing diagram for illustrating the operation of the activation circuit shown in FIG. 8.

Reference is now also made to FIG. 9 in which timing charts for explaining the operation of the activation circuit are provided. It is assumed in the following description that the odd-numbered rows are driven by actuator coils 70*a* and 70*c* and the even-numbered rows by actuator coils 70*b* and 70*d*.

CPU 60 outputs a timing control signal $S_1$ that essentially determines the movement of the carriage (not shown) and the timing of printing. First driving signal-generating circuit 66 outputs a first driving signal $S_2$ having a pulse width $T_{1a}$ in synchronism with the leading edge of timing control signal $S_1$. The first terminals $S_{1a}$, $S_{1b}$, $S_{1c}$, $S_{1d}$ of the gate array 65 output driving signal $S_2$ level to transistors 68*a*, 68*b*, 68*c*, 68*d* to bias each odd row first switching transistor 69*a* and 69*c* into conduction after $\Delta$ T has elapsed corresponding to the turn-on characteristics of the devices.

Simultaneously first driving signal $S_2$ is output by first driving signal-generating circuit 66 to delay circuit 67 and then to second driving signal-generating circuit 75 delayed by a delay time $\Delta$ T which is preset in delay circuit 67. Thus, the timing at which gate array 65 operates is determined. Gate array 65 also receives data concerning printed characters from CPU 60 and produces a second driving signal $S_3$ through a plurality of terminals $S_{3a}$, $S_{3b}$, $S_{3c}$, $S_{3d}$ connected to a corresponding actuator coil such as 70*a* or 70*c*.

Since the first switching transistors 69*a* and 69*c* conduct concurrently with the second switching transistors 71*a*, 71*b*, 71*c*, 71*d* as described above, the DC voltage from the DC power supply is applied to actuator coil 70*a* or 70*c* when second switching transistor 71*a* is driven into conduction. The associated actuator coil 70*a* or 70*c* is supplied with electric current $I_{1a}$ which increases with a time constant determined by its reactance and internal resistance. When the time determined by the pulse width $T_{1a}$ of first driving signal-generating circuit 66 elapses first switching transistor 69*a* or 69*c* is biased into a cutoff state, so that the associated coil 70*a* or 70*c* no longer receives electric current from the driving DC power supply.

Second driving signal generating circuit 75 continues to produce second driving signal $S_3$ to maintain second switching transistor 71*a* in conduction. The counter electromotive force induced in actuator coil 70*a* due to cutoff of first switching transistor 69*a* produces a circulating current $I_{1b}$ that flows through second switching transistor 71*a*, diode 74*a*, and actuator coil 70*a*. This makes coil 70*a* continue to produce magnetic flux, thus attracting the print lever. When the time $T_{1c}$ passes, driving signal $S_3$ output by second driving signal-generating circuit 75 ceases to cause second switching transistor 71*a* to maintain a cutoff state. Then, the counter electromotive force induced in coil 70*a* produces electric current $I_1c$ which flows through coil 70*a*, diode 73*a*, and the terminal Vp of the DC power supply. When the counter electromotive force decreases below the sum of the voltage at the power terminal Vp and the forward voltage of the diode 73*a*, the electric current ceases flowing. The residual magnetic flux decreases gradually.

When the first printing step ends, CPU 60 produces a next timing control signal $S_1$ to permit actuator coils 68*b* and 68*d* not energized in the first printing step to be energized. More specifically, when the second timing control signal $S_1$ is output, first driving signal-generating circuit 66 produces a signal having a pulse width $T_{2a}$. First switching transistors 69*b* and 69*d* receive this signal of pulse width $T_{2a}$ and are biased into conduction after a lapse of time determined by the turn-on characteristics of level conversion transistor 68*b*, 68*d* and first switching transistors 69*b* and 69*d*. The conducting transistors 69*b* and 69*d* apply a voltage to even row actuator coils 69*b* and 69*d*. First driving signal $S_2$ produced by first driving signal-generating circuit 66 is input to delay circuit 67 and then to second driving signal-generating circuit 75 after a delay Δ T. Circuit 75 outputs second driving signal $S_3$ having a pulse width $T_{2c}$.

Because of this delay, first switching transistors 69*b* and 69*d* are turned on simultaneously with or earlier than second switching transistor 68*b* regardless of the delay introduced by the time required for the front-stage second switching transistors 71*b* and 71*d* to be biased into cutoff. Then, the voltage from the DC power supply is applied to diodes 74*b* and 74*d* to bias them into cutoff. At this time, actuator coils 70*a* and 70*c* that were energized during the previous activation are still affected by the residual magnetic flux and keep producing electromagnetic force. However, the voltage from the DC power supply keeps diodes 74*b* and 74*d* in cutoff. Therefore, the counter electromotive force induced in actuator coils 70*a* and 70*c* is not able to produce electric current. In this way, the electromotive force attributed to the residual magnetic flux develops no electric current. Hence, each lever moves just as intended and returns to its home position. Thus, it is ready for the next activation.

It is necessary that the pulse widths $T_{1a}$ and $T_{1c}$ be selected to have their maximum values in synchronism with the period of the response of the head. Generally, if the input pulse widths are long, the residual magnetic flux delays the restoration, producing imperfect printing. Also, it is difficult to print characters at a high speed. On the other hand, if the pulse durations are short, it is necessary to supply a large amount of energy to the actuator coil, thus increasing the eddy current loss. As a result, the actuator coil produces unwanted heat. Experiment has shown that if the optimum pulse durations $T_{1a}$ and $T_{1c}$ and the period $T_1$ of the response should satisfy the relations:

$$0.25 \leqq \frac{T_{1a} + T_{1c}}{T_1} \leqq 0.5$$

and

-continued $$0.5 \leqq \frac{T_{1a}}{T_{1a} + T_{1c}} \leqq 0.9$$

good results are obtained.

Preferably, the pulse widths $T_{1a}$ and $T_{1c}$ are modified according to the thickness of the paper. If the paper is thick, $T_{1a}$ and $T_{1c}$ are changed to values longer than the set values. If the paper is thin, the modified pulse widths $T_{1a}$ and $T_{1c}$ are short constant times. Also, it is desired to change the pulse width $T_{1a}$ according to either the power voltage applied to each actuator coil or the voltage applied between the two terminals of each actuator coil. The changed pulse width is empirically obtained and given by $$T_{1a} = A \ln\left(1 - \frac{B}{V_p}\right)$$

where $V_p$ is the detected voltage applied to the actuator coil, A and B are constant and assume values defined as follows:

$200 \leqq A \leqq 800$, $3 \leqq B \leqq 30$

The relationship between the voltage applied to the actuator coil and the pulse width $T_{1a}$, $T_{1c}$ are shown in FIGS. 13*a*, 13*b* by way of example.

Figure 10:
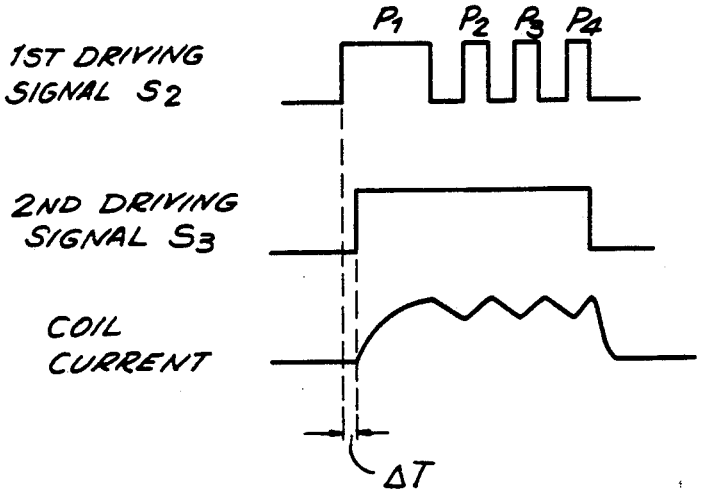
FIG. 10 is a waveform diagram of signals obtained from an activation circuit constructed in accordance with another embodiment of the invention in which the circuit includes a chopper.

In the above embodiments each first switching transistor is driven with a single pulse signal. In a chopping driving system, one period of the first driving signal forming a common signal is divided into plural pulses $P_1$, $P_2$, $P_3$, and $P_4$ so that the coil current may rise at a higher speed as shown in FIG. 10. The leading edge of the second driving signal $S_3$ is delayed by the time Δ T with respect to the leading edge of the first pulse $P_1$ of the first driving signal $S_2$. This yields the same advantages as the above embodiments. Only the second driving signal $S_3$ is delivered after the trailing edge of the pulse $P_1$. At this time, the printing wire is being accelerated and the electric current arising from the counter electromotive force contributes to the acceleration of the wire without adverse effect.

Figure 11:
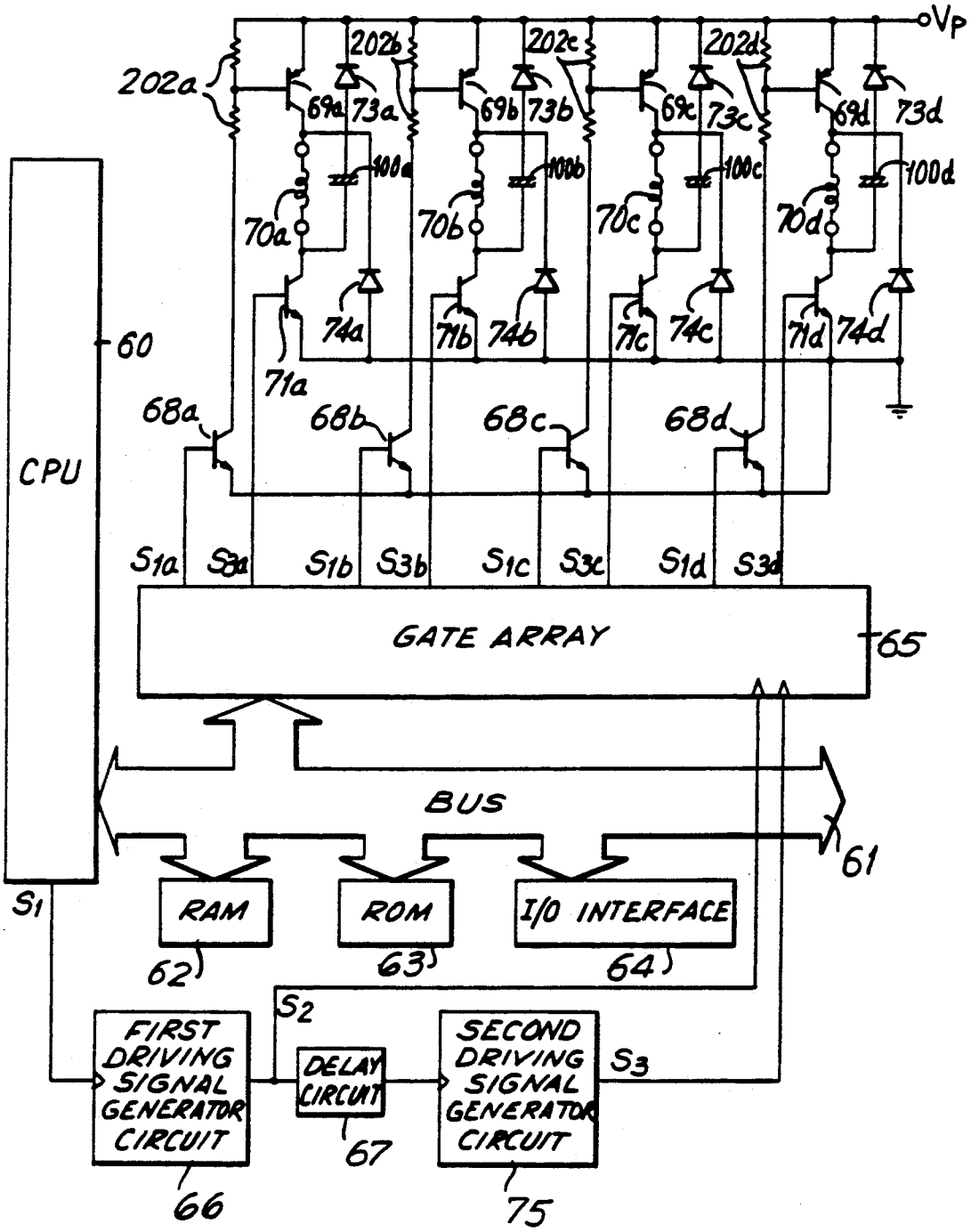
FIG. 11 is a block diagram of a driving circuit constructed in accordance with another embodiment of the invention.

Reference is now made to FIG. 11 in which a block diagram of another embodiment of a print head activation circuit is provided. The embodiment of FIG. 11 is similar to that of FIG. 8, the primary difference being the addition of capacitors. Accordingly, like numerals are utilized to indicate like characters.

A plurality of capacitors 100*a*–100*d* are connected in parallel between terminal Vp and ground, one being connected across each series connection of the emitter-collector paths of a corresponding first and second switching transistor 69*a*–69*d* and 71*a*–71*d* and coils 70*a*–70*d* to regulate the electric currents supplied to respective actuator coils 70*a*–70*b* when the levers are driven. The respective emitter-collector paths of first and second switching transistors 69*a*–69*d* and 71*a*–71*d* are disposed on opposed sides of the associated one of coils 70*a*–70*d*. Capacitors 100*a*–100*d* act as electrical power-storing means when the coils 70*a*–70*b* are not energized.

Figure 12:
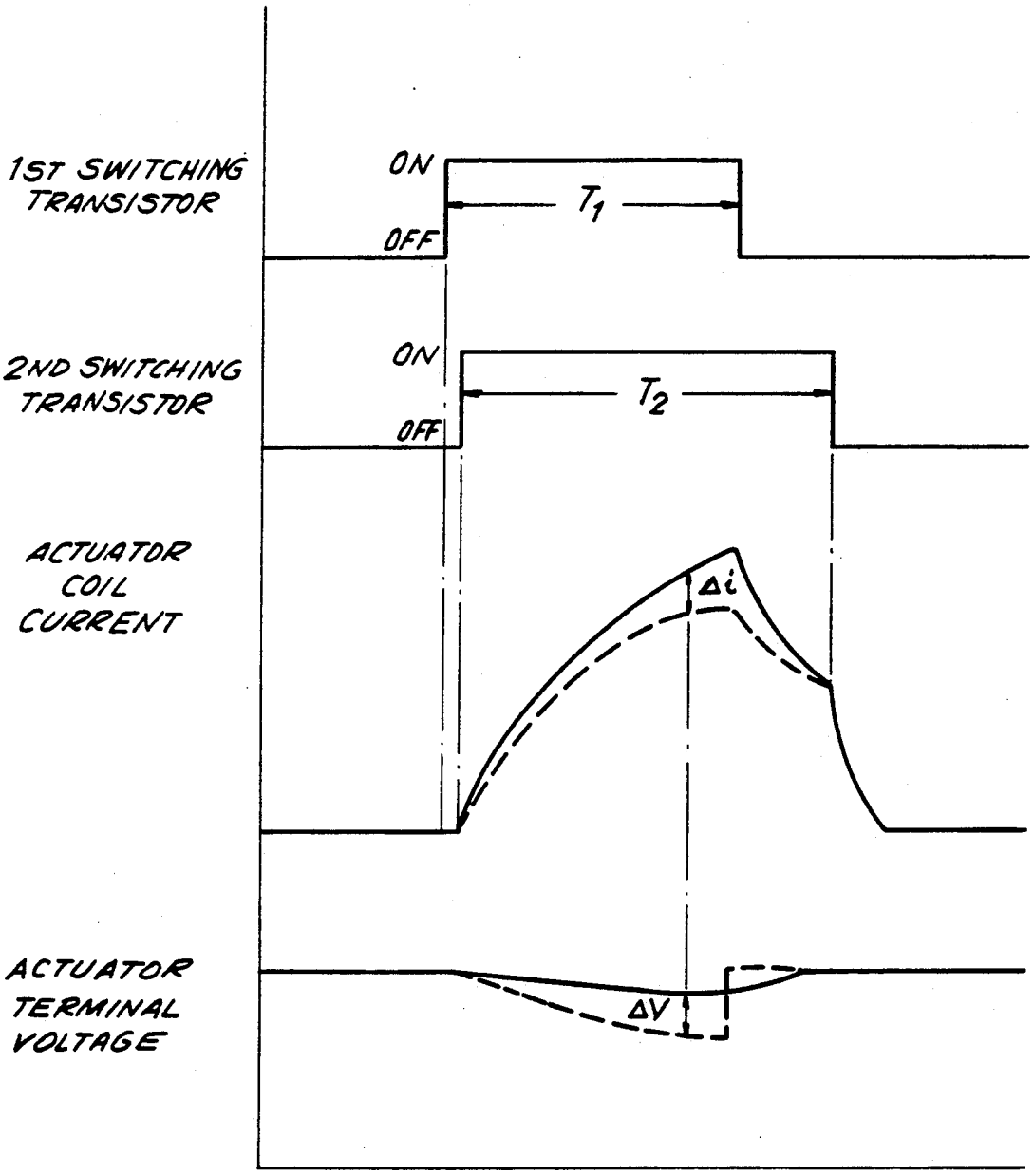
FIG. 12 is a timing chart for the operation of the activation circuit of FIG. 11.

The capacitance values of capacitors 100*a*–100*d* are set so that:

$$C\Delta V^2 = L\Delta i^2$$

is satisfied to prevent a drop Δ i cf the electric current during activation as shown in FIG. 12. In the above equation, C is the capacitance of each capacitor, and L is the inductance of the actuator coil. In the embodiment of FIG. 11, a single capacitor is connected with each individual actuator coil. Obviously, a capacitor can be connected with plural actuator coils provided that the relation $$C = L\left(\frac{\Delta i}{\Delta V}\right)^2$$

is fulfilled.

It will thus be seen that the objects set forth above, among those apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which as a matter of language might be said to fall therebetween.

What is claimed is:

1. A print head activation circuit for a wire dot printer driven by a DC power supply having at least one actuator coil having a first terminal and a second terminal comprising:

first switching means coupled between the DC power supply and the first terminals of the actuator coils for selectively energizing the actuator coils, the DC power supply being coupled at an input of said first switching means and said actuator coils being coupled at an output of said first switching means;

a second switching means for selectively energizing each actuator coil coupled between the second terminal of each said actuator coil and ground;

control means for producing a print timing control signal;

first driving signal generating means for producing a first driving signal pulse having a pulse width $T_{1a}$ in response to said print timing control signal, the first switching means being controlled in response to the first driving signal;

signal delaying means for receiving the first driving signal, delaying the first driving signal by Δ T and outputting a delayed first driving signal;

second driving signal generating means for producing a second driving signal pulse simultaneously with a leading edge of the delayed first driving means, the second driving signal pulse having a pulse width $T_{1c}$ that is greater than the pulse width $T_{1a}$, the second switching means being controlled in response to the second driving signal, Δ T being large enough that the first switching means is controlled simultaneously with or earlier than the second switching means.

2. The activation circuit of claim 1, further comprising counter electromotive force absorbing means connected between the DC power supply and the second terminals of the actuator coils for absorbing the counter electromotive force stored in the coil after it has been energized.

3. The activation circuit of claim 1, further comprising level conversion means connected between said DC power supply and said first switching means for increasing the level of said first driving signal and inputting said increased driving signal to said first switching means.

4. The activation circuit of claim 2, further comprising at least a first diode connected between said counter electromotive force absorbing means and each said second terminal of said each respective actuator coil.

5. The activation circuit of claim 1, wherein said second switching means is placed in a conduction state or a non-conduction state in response to the second driving signal and the first switching means is placed in a conduction state or non-conduction state in response to the first driving signal.

6. The activation circuit of claim 1, wherein said signal delaying means includes a transistor and Δ T corresponds to the time required for said transistor to be biased into a conduction state.

7. The activation circuit of claim 1, wherein said signal delaying means includes an integrator circuit, said integrator circuit including a resistor and capacitor.

8. The activation circuit of claim 1, wherein said signal delaying means includes at least one inverter circuit, the value for Δ T increasing with the number of invertor circuits.

9. The activation circuit of claim 2, wherein said electromotive force absorbing means includes a voltage-regulating diode.

10. The activation circuit of claim 2, wherein said electromotive force absorbing means includes a voltage-regulating diode and a transistor, the diode being connected between the emitter and the collector of the transistor.

11. The activation circuit of claim 2, wherein said counter electromotive force absorbing means includes a voltage-regulating diode and transistor, said diode being coupled between the base of the transistor and collector of the transistor.

12. The activation circuit of claim 2, wherein said counter electromotive force absorbing means further comprises a first transistor and a second transistor, the collector of the first transistor being connected to the base of the second transistor and the emitter of the first transistor being connected to the collector of the second transistor.

13. The activation circuit of claim 1, wherein said first switching means includes at least one transistor.

14. The activation circuit of claim 1, wherein said second switching means includes at least one transistor.

15. The activation circuit of claim 2, wherein the counter electromotive force absorbing means includes a diode coupled between the first terminal of a respective actuator coil and ground in a reverse direction as viewed from the DC power supply.

16. The activation circuit of claim 1, wherein said pulse width $t_{1a}$ satisfies the relationship:

$$T_{1a} = A\ ln(1 - B/V_p)$$

$$200 \leqq A \leqq 800$$

$$3 \leqq B \leqq 30$$

wherein A and B are a constant value and $V_p$, is the voltage of the DC power supply.

17. A print head activating circuit for a wire dot printer driven by a DC power supply having at least one actuator coil having a first terminal and a second terminal comprising:

a first switching means for selectively energizing each actuator coil and coupled between the DC power supply and the first terminal of the associated actuator coil, the DC power supply being coupled at an input of said first switching means and said actuator coils being coupled at an output of said first switching means;

a second switching means for selectively energizing each of the actuator coils coupled between the second terminal of the associated actuator coil and ground;

at least one first diode coupled between the first terminal of each respective actuator coil and ground in a reverse direction as viewed from the DC power supply;

at least one second diode, each second diode being connected between the second terminal of an actuator coil and the DC power supply in the reverse direction as viewed from the DC power supply;

control means for producing a print timing control signal having a pulse width $T_1$;

first driving signal generating means for producing a first driving signal pulse having a pulse width $T_{1a}$ in response to said print timing control signal, the first switching means being controlled in response to the first driving signal;

signal delaying means for receiving the first driving signal, delaying the first driving signal by $\Delta T$ and outputting a delayed first driving signal;

second driving signal generating means for producing a second driving signal pulse in response to the leading edge of the delayed first driving signal, the second driving signal pulse having a pulse width $T_{1c}$ that is greater than the pulse width $T_{1a}$, the second switching means being controlled in response to the second driving signal, $\Delta T$ being large enough that the first switching means is controlled simultaneously with or earlier than the second switching means.

18. The activation circuit of claim 17, further comprising level conversion means connected between said DC power supply and said first switching means for increasing the level of said first driving signal and inputting said increased driving signal to said first switching means.

19. The activation circuit of claim 17, wherein said second switching means is placed in a conduction state or a non-conduction state in response to the second driving signal and the first switching means is placed in a conduction state or non-conduction state in response to the first driving signal.

20. The activation circuit of claim 17, wherein said signal delaying means includes a transistor and $\Delta T$ corresponds to the time required for said transistor to be biased into a conduction state.

21. The activation circuit of claim 17, wherein said signal delaying means includes an integrator circuit, said integrator circuit including a resistor and capacitor.

22. The activation circuit of claim 17, wherein said signal delaying means includes at least one inverter circuit, the value for $\Delta T$ increasing with the number of invertor circuits.

23. The activation circuit of claim 17, wherein said first switching means includes at least one transistor.

24. The activation circuit of claim 17, wherein said second switching means includes at least one transistor.

25. The activation circuit of claim 17, further comprising a plurality of capacitors each capacitor being connected between the connection of ground and one of said second switching means and the connection of the DC power supply and the corresponding one of said first switching means.

26. The activation circuit of claim 17, wherein said pulse width $T_{1a}$ and said pulse width $T_{1c}$ satisfy the relationship $$0.25 \leqq \frac{T_{1a} + T_{1c}}{T_1} \leqq 0.5$$

and $$0.5 \leqq \frac{T_{1a}}{T_{1a} + T_{1c}} \leqq 0.9$$

27. The activation circuit of claim 17, wherein said first driving signal includes a plurality of pulses each pulse a pulse width less than $T_{1a}$.

28. The activation circuit of claim 17, wherein said pulse width $T_{1a}$ satisfies the relationship:

$$T_{1a} = A \ ln(1 - B/V_p)$$

$$200 \leqq A \leqq 800$$

$$3 \leqq B \leqq 30$$

wherein A and B are a constant value and $V_p$ is the voltage of the DC power supply.

29. The activation circuit of claim 15, further comprising level conversion means connected between said DC power supply and said first switching means for increasing the level of said first driving signal and inputting said increased driving signal to said first switching means.

30. The activation circuit of claim 15, wherein said second switching means is placed in a conduction state or a non-conduction state in response to the second driving signal and the first switching means is placed in a conduction state or non-conduction state in response to the first driving signal.

31. The activation circuit of claim 15, wherein said signal delaying means includes a transistor and $\Delta T$ corresponds to the time required for said transistor to be biased into a conduction state.

32. The activation circuit of claim 15, wherein said signal delaying means includes an integrator circuit, said integrator circuit including a resistor and capacitor.

33. The activation circuit of claim 15, wherein said signal delaying means includes an integrator circuit, and value for $\Delta T$ increasing with the number of invertor circuits.

34. The activation circuit of claim 15, wherein said first switching means includes at least one transistor.

35. The activation circuit of claim 15, wherein said second switching means includes at least one transistor.

36. The activation circuit of claim 15, wherein said pulse width $T_{1a}$ satisfies the relationship:

$$T_{1a} = A \ ln(1 - B/V_p)$$

$$200 \leqq A \leqq 800$$

$$3 \leqq B \leqq 30$$

wherein A and B are a constant value and $V_p$ is the voltage of the DC power supply.

* * * * *